United States Patent [19]

Liebscher

[11] 4,028,765

[45] June 14, 1977

[54] FLOOR OR CARPET SWEEPER

[75] Inventor: Johannes Liebscher, Nassau, Lahn, Germany

[73] Assignee: Leifheit International Gunter Leifheit GmbH, Nassau, Lahn, Germany

[22] Filed: July 19, 1976

[21] Appl. No.: 706,564

[30] Foreign Application Priority Data

July 24, 1975 Germany ..... 2533071

[52] U.S. Cl. ..... 15/42

[51] Int. Cl.[2] ..... A47L 11/32

[58] Field of Search ..... 15/41 R–48

[56] References Cited

UNITED STATES PATENTS

| | | | |
|---|---|---|---|
| 2,611,913 | 9/1952 | Buquor | 15/41 R |
| 3,818,532 | 6/1974 | Leifheit et al. | 15/42 |

FOREIGN PATENTS OR APPLICATIONS

| | | | |
|---|---|---|---|
| 2,239,135 | 2/1974 | Germany | 15/42 |
| 1,013,085 | 12/1965 | United Kingdom | 15/41 R |

*Primary Examiner*—Edward L. Roberts
*Attorney, Agent, or Firm*—Michael J. Striker

[57] ABSTRACT

A floor or carpet sweeper has a hollow housing provided on its lower side with a plurality of floor-engaging wheels. The bottom of the housing is closed by means of a cover plate which is pivoted on the housing about an axis perpendicular to the forward and backward direction of travel of the housing during sweeping. This cover plate is formed with a throughgoing hole and is provided with upwardly bent tabs on which a cylindrical brush is rotatably mounted, this brush extending through the hole in the plate. In addition the ends of the brush are engageable with the wheels when the cover plate is closed on the housing so that the brush is rotatably driven by these wheels. A magnet holds the cover plate in place on the bottom of the housing and engages against an inclined surface on this cover plate. This magnet can be moved along the inclined surfaces so as to vary the height setting of the brush.

13 Claims, 16 Drawing Figures

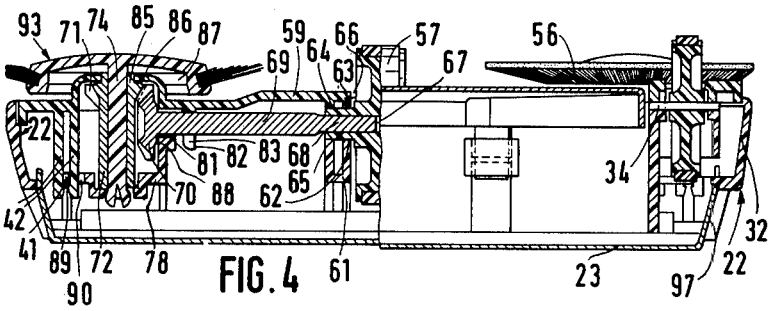
FIG. 4
FIG. 2
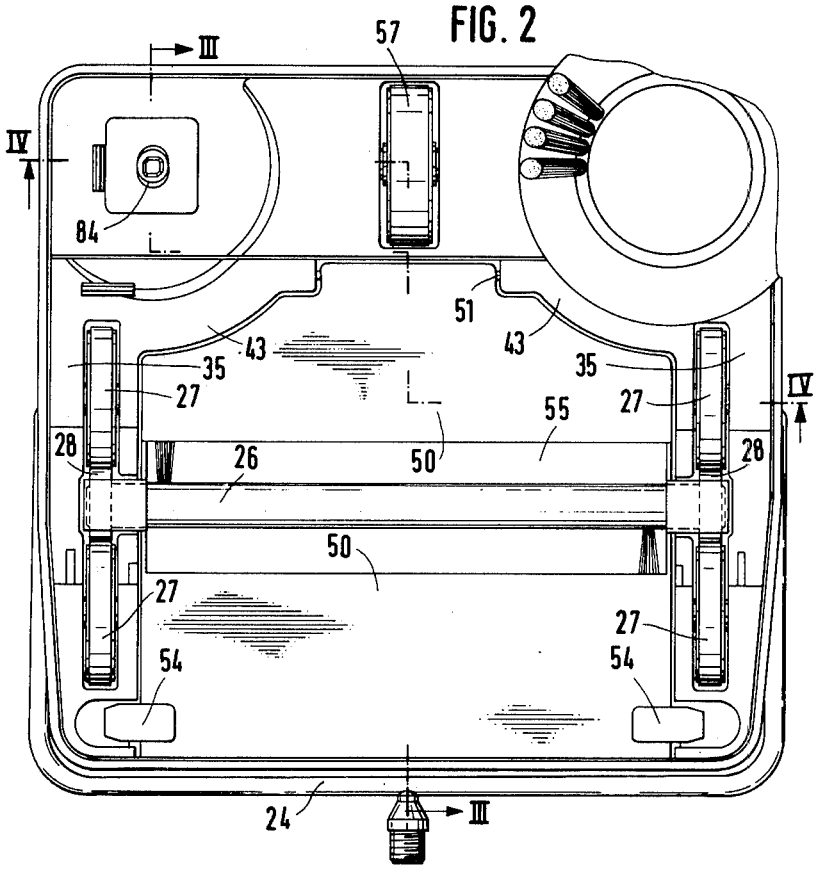

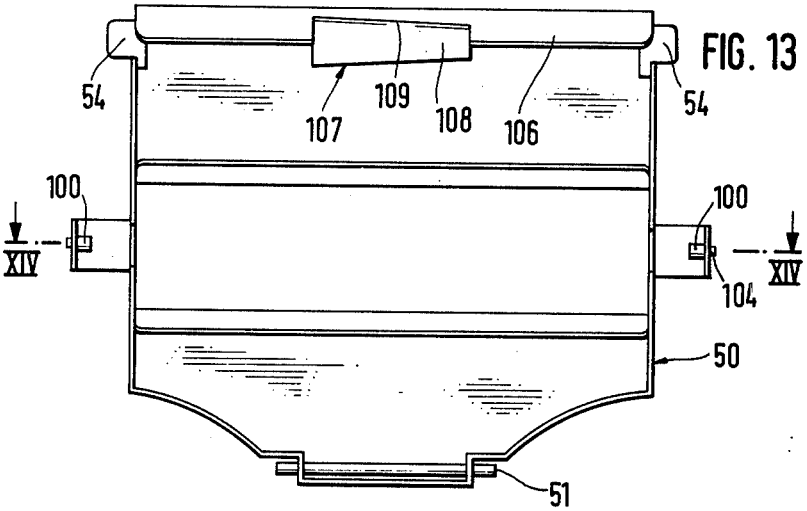
FIG. 13
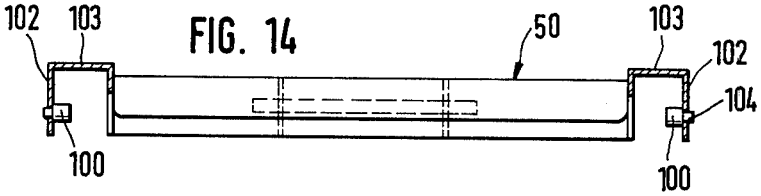
FIG. 14
FIG. 15
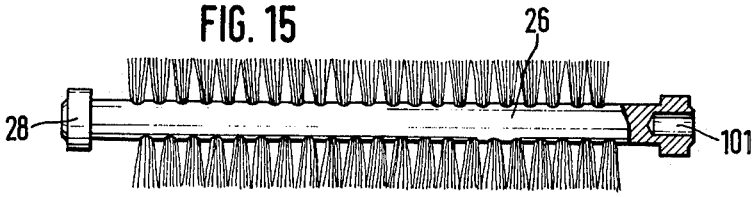
FIG. 16
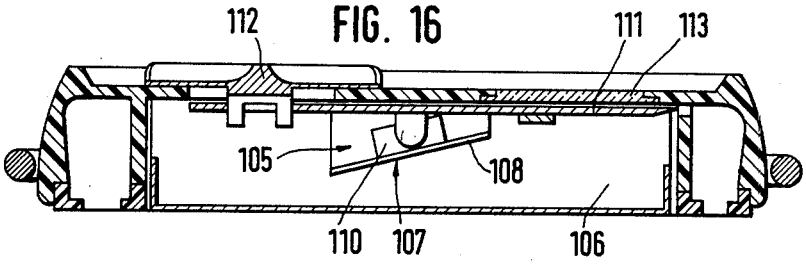

FLOOR OR CARPET SWEEPER

CROSS-REFERENCE TO RELATED APPLICATION

This application is related to the commonly assigned and copending patent application 662,934 filed Mar. 1, 1976.

BACKGROUND OF THE INVENTION

The present invention relates to a floor or carpet sweeper. More particularly this invention relates to such a sweeper having a cylindrical brush rotatable about an axis transverse to the normal direction of travel of the sweeper over a surface being cleaned.

Such a floor-sweeper is already known and in widespread use and usually includes a housing in which there are mounted bearings for the shafts of driving wheels which rotate in engagement with the surface being cleaned and which drive the cylindrical brush into rotation about its axis. The housing usually includes a rigid circumferential frame, and the bearings for the shafts of the driving wheels are usually located in the lateral regions of the housing adjacent the lateral walls of the circumferential frame. The conventional housing further includes a cover which closes that side of the housing which faces away from the surface to be swept during the use of the cleaning device.

In this conventional floor-sweeper, the bearings are constituted as discrete elements which are separate from the housing and also separetely manufactured, such bearings having guiding and connecting portions. The frame of the housing of this conventional floor-sweeper then includes complementary guides in which the guiding portions of the bearing elements are received, the connecting portions of the bearings connecting them to the housing and preventing the bearings from moving relative to the housing once they have been assembled.

Experience with this type of floor-sweeper has shown that their manufacture is rather complex and consequently expensive for several reasons. First of all it is necessary in such a conventional floor-sweeper to separately produce the frame of the housing of the floor-sweeper device and the respective bearings, and then employ a separate assembling operation in which the bearings are introduced into the guiding portions of the frame of the housing, properly positioned in such guiding portions, and connected to the frame in such proper positions. On the other hand, the respective components which together form the housing, that is the frame and the bearing elements, must have sufficiently large wall thickness for the frame and the bearings to have the required rigidity, which is especially true when the various components are made of synthetic plastic material. The consumption of material is further increased by the need for providing the various guiding portions on the frame and on the bearing elements, which guiding portions then either cause or call for a further increase in the wall thickness of the various components. The increased material consumption not only increases the cost of manufacturing the device, but also make the floor-cleaning device rather bulky, heavy, and unwieldy.

In such a convention floor-sweeper the bottom of the housing is closed by means of a cover plate which is pivoted usually at the back of the housing about an axis parallel to the rotation axis of the cylindrical brush and perpendicular to the normal direction of travel of the sweeper. This cover plate can be pivoted away from the housing in order to expose the dust-receiving receptacles and allow the sweeper to be emptied out after a cleaning operation.

The disadvantage of this type of construction is that the dust in the receptacles often catches on the brush requiring vigorous shaking of the apparatus so that its cleaning-out is an onerous job.

Furthermore such arrangements normally do not allow for a simple adjustment of the relative heights of the brush and the wheels so that the device cannot be used on bare floors or high-pile carpets. In some of the arrangements which have a height adjustment for the brush the complicated mechanism required for such height adjustment increases the cost and complexity of the sweeper considerably.

SUMMARY OF THE INVENTION

Accordingly, it is a general object of the present invention to avoid the disadvantages of the prior art floor-sweeping devices.

More particularly, it is an object of the present invention to provide a cleaning device in which the housing can be manufactured in a simple and economical manner.

A further object of the present invention is to provide a cleaning device of the type here under discussion which is simple in construction and inexpensive to manufacture.

A concomitant object of the present invention is to so construct the housing of the floor-cleaning device that it can be manufactured in a simple way of one piece, such as in an injection-molding operation.

Yet another object of the present invention is to provide a housing for use in a floor-sweeping device which is very light in weight but sufficiently rigid nevertheless.

It is a still further object of the present invention to provide a cleaning device the component parts of which can be very easily assembled.

Another object of the present invention is to provide a floor sweeper which can readily be cleaned out.

A final object of the present invention is the provision of a floor sweeper wherein the main roller height can readily be adjusted.

These objects are attained according to the present invention in a floor sweeper of the above-defined general type wherein means is provided on the bottom cover plate for rotatably mounting the brush. Thus, in accordance with this invention when the housing is opened up for cleaning the brush is displaced out of the way along with the bottom cover plate. This mounting means comprises in accordance with this invention pins aligned with the rotation axis of the brush and either carried on the ends of the brush engaging at holes and tabs on the plate or carried on tabs on the plate and engaged in holes at the ends of the brush. Such mounting is relatively inexpensive to carry out in practice and at the same time provides a very sure and sturdy mounting of the sweeping brush.

According to yet another feature of this invention the cover plate is made of ferromagnetic sheet metal and is formed with a bent up tongue having an inclined surface which is engageable with a magnet carried on the housing and constituting means for varying the height of the bottom cover plate and, therefore, of the brush relative to the housing. This magnet can be displaced via a handle accessible from outside the housing in order to allow height adjustment of the brush. Furthermore, according to this invention indicia is provided connected to the magnet and visible through a window on the housing so that the user can readily ascertain what height the brush is set at.

According to another feature of this invention the sweeper comprises a housing having a longitudinal and a transverse axis and transversely spaced lateral regions. The housing includes a pair of support walls or webs at each of the lateral regions of the housing and extending substantially parallel to the longitudinal axis of the housing with transverse spacing from one another. A plurality of wheels is mounted on the support webs intermediate same for rotation in engagement with the surface to be cleaned, the mounting means for the wheels including bearing recesses in the support walls, having open ends facing toward the surface to be cleaned, mounting shafts for the wheels having mounting portions supported in the bearing recesses, and at least one cover mounted on the housing and having closing portions which close the open ends of the bearing recesses. In the currently preferred embodiment of the invention, the housing further includes a frame which has longitudinally spaced front and rear walls and transversely spaced lateral walls, and the support webs are situated between the respective lateral walls of the frame and the longitudinal axis. The frame is thus open both toward and away from the surface to be cleaned, so that it can be manufactured in a simple manner in a simple mold, particularly since the pairs of the support webs which are provided with the bearing recesses which are open toward the surface to be cleaned can be shaped or molded without encountering any difficulties. On the other hand, the provision of the support webs increases the stability of the frame so that the thickness of the frame, and particularly of the lateral walls thereof, can be much smaller than heretofore known. In this manner, a substantial saving of the material of which the housing is made is obtained.

According to a further concept of the present invention, the housing may further include a plurality of reinforcing walls which extend between and are rigidly connected with the respective lateral walls and the respective support webs of the housing. The reinforcing walls may extend not only between the support webs of each pair, but also between the inner ones of the support webs of the pairs of support webs which are located at opposite lateral regions of the housing. In this manner the rigidity of the frame is further improved.

In a currently preferred embodiment of the present invention the closing portions of the cover include complementary bearing recesses which are open toward and aligned with the bearing recesses of the support webs. Thus, the mounting portions of the mounting shafts of the wheels are reliably received in the bearing recesses.

The cover is provided, in a known manner, with arresting arms which are formed with arresting banks or projections cooperating with detent recesses and detachably connecting the cover to the housing and support walls thereof. In this manner, a particularly simple assembling operation of the floor-sweeper is obtained, particularly since it is merely sufficient to introduce the mounting portions of the mounting shafts of the wheels into the respective bearing recesses and then to connect a cover to the frame by means of the arresting arms. A simple pressing of the cover against the frame is sufficient to connect the cover to the frame. On the other hand it is equally possible to disassemble the cover from the frame by simply deflecting the arresting arms to thereby discontinue the snap-action connection of the latter with the detent recesses of the frame.

According to another feature of this invention at least one cylindrical cleaning body constituting the above-mentioned brush is mounted in the housing for rotation about an axis which is substantially parallel to the transverse axis of the housing, and the wheels are in driving contact with the cylindrical cleaning body so as to rotate the same about the axis. In this embodiment, each complementary bearing recess and the associated bearing recess together form an elongated slot which is inclined with respect to a surface to be cleaned. Preferably, the elongated slot has one end which is closer to the cylindrical cleaning body and more spaced from the surface to be cleaned, and another and more spaced from from cylindrical cleaning body and closer to the surface to be cleaned so that the forces which act on the device during the use thereof displace the mounting portion of the mounting shaft toward the one end of the elongated slot and thus the respective cleaning body. In this manner, virtually skidless frictional engagement of the respective driving wheel with the cylindrical cleaning body is obtained. Preferably, the cleaning body is a cylindrical brush which has britles engageable with the surface to be cleaned.

In a further currently preferred embodiment of the present invention, the housing includes a partition which extends substantially parallel to the transverse axis between the same and the front wall, and mounting walls extending between the partition and the front wall. This embodiment of the device of the present invention further comprises at least one corner-sweeping brush, at least one auxiliary wheel for driving the corner-sweeping brush, and means for supporting the corner-sweeping brush and the auxiliary wheel on the mounting walls so that the corner-sweeping brush rotates about a brush axis extending from the housing toward the surface to be cleaned. The supporting means of this embodiment supports the corner-sweeping brush at one of the lateral regions of the housing, and the corner-sweeping brush has bristles which extend radially outwardly of the brush axis and beyond the front wall and the respective lateral wall of the housing. In this manner, even the bearing for the corner-sweeping brush is likewise formed on the frame. The mounting walls of this embodiment can be formed or molded together with the frame in a simple manner, and the rigidity of the frame is further improved.

The partition, each inner of the support webs, and the rear wall of the housing together circumferentially bound a confining space, and at least one dirt-collecting receptacle is mounted within the confining space. In this manner, the respective support walls and partition separate the spaces accommodating the bearings for the respective wheels and the bearing for the corner-sweeping brush from the confining space so that the dirt accumulating in the latter is prevented from reaching and soiling such bearings.

The partition and the front wall of the housing together bound an enclosed space, and a closure closes the enclosed space in direction toward the surface to be cleaned. In this manner, the housing, which was originally open at its both ends facing either toward the surface to be cleaned or away from the same is closed even in this region.

The closure is provided, in a known manner, with arresting arms which are equipped with arresting projections cooperating with detent recesses for detachable connection of the closure to connecting portions of the housing. In this manner, the closure is also attached to the frame of the housing in an exceedingly simple manner.

It is further proposed by the present invention that the supporting means each include at least one auxiliary bearing recess which has an open end facing toward the surface to be cleaned, and an auxiliary shaft for the auxiliary wheel which is partly received in the auxiliary bearing recess, the closure having at least one auxiliary closing portion which closes the open end of the auxiliary bearing recess. The closure may have additional mounting walls which are aligned with the above-mentioned mounting walls of the housing and provided with the contact portions, and the respective closing portion may be shaped so as to circumferentially complete the bearing for the auxiliary shaft of the auxiliary wheel. This assures a very simple mounting of the auxiliary shaft of the auxiliary wheel in the housing.

A further currently preferred embodiment of the present invention further comprises an additional corner-sweeping brush which is similar to the above-mentioned corner-sweeping brush, and the supporting means supports the corner-sweeping brush at one, and the additional corner-sweeping brush at the other lateral region of the housing. In this embodiment, the housing includes compartmenting walls which extend between the front wall and the partition and bound a compartment partially receiving the auxiliary wheel.

The cleaning device of this embodiment further comprises means for carrying the auxiliary wheel on the compartmenting walls which includes additional bearing recess having open ends facing toward the surface to be cleaned, and an auxiliary mounting shaft partly received in the additional bearing recesses for rotation. In this embodiment, the corner-sweeping brush and the additional corner-sweeping brush each have a respective brush shaft. A bevel gear transmission is interposed between an auxiliary mounting shaft and each of the respective brush shafts and is operative for rotating the latter in response to rotation of the auxiliary shaft. As a result of this arrangement of the compartmenting walls, the auxiliary wheel is mounted in the housing in an especially simple manner, and also very reliably, especially when more than one compartmenting wall is arranged to each side of the auxiliary wheel. In the latter instance, the bearing for the auxiliary shaft is very broad, even though the individual compartmenting walls may be advantageously relatively thin.

According to a further advantageous concept of the present invention the closure includes additional compartmenting walls which are aligned with the compartmenting walls of the housing when the closure is attached to the housing, the closure being provided with a passage for the auxiliary wheel intermediate the additional compartmenting walls and having additional closing portions which close the open ends of the additional bearing recesses. Advantageously, the additional closing portions are so configurated as to circumferentially complete the bearing recesses for the auxiliary shaft. In this manner, the auxiliary shaft of the auxiliary wheel is supported in a relatively broad bearing from all sides thereof.

The corner-sweeping brush has a brush body and a brush shaft, and the mounting walls include at least one mounting wall portion which extends parallel to the surface to be cleaned. In this embodiment, the supporting means includes a bearing depression in the mounting wall portion adapted to receive an end portion of the brush shaft which is remote from the brush body. This mounting wall portion which extends parallel to the surface to be cleaned can also be formed in a simple manner and in a simple mold.

The supporting means further includes an annular reinforcing portion on the mounting wall portion, the reinforcing portion circumferentially surrounding the bearing depression provided in the mounting wall portion which extends parallel to a surface to be cleaned. This reinforcing portion can also be easily formed together with the remainder of the housing, also in a very simple mode.

Furthermore, the mounting walls may include at least one mounting wall section which extends between the partition and the front wall and substantially normal to the surface to be cleaned. The supporting means includes at least one further bearing recess which has an open end facing the surface to be cleaned, and an auxiliary shaft for the auxiliary wheel is partly received in the further bearing recess. In this embodiment, the closure has at least one further mounting wall section which is aligned with the mounting wall section of the housing when the closure is attached to the housing and which has a further closing portion which closes the open end of the further bearing recess. Thus, the auxiliary shaft which connects the auxiliary wheel with the corner-sweeping brush is also mounted on the housing at its region which is close to the shaft of the corner-sweeping brush. The bearing for this auxiliary shaft in this region is also very easy to manufacture.

This embodiment for the present invention further comprises means for holding the corner-sweeping brush in the closure, the holding means including a bearing aperture in the closure for accommodating the end of the brush shaft which is close to the brush body. The brush body has an annular depression at the end thereof which faces the closure, and the closure has an outwardly bulging projection which is accommodated within the annular depression of the brush body and provided with the abovementioned aperture. This bearing for the close end of the brush shaft can also be formed in a very simple manner on the closure.

The cleaning device of the present invention further comprises a protective cover for closing that end of the frame which faces away from the surface to be cleaned, the protective cover being of sheet metal. The profiled element has front and rear marginal portions which are inclined with respect to the remainder of the profiled element which forms the protective cover, and the frame includes clamping portions which receive and clamp the marginal portions of the profiled element. In this manner, that side of the frame of the housing which faces away from the surface to be cleaned can be closed in a very simple manner by merely pressing the sheet-metal profiled elementagainst the frame of the housing.

The profiled element which constitutes the protective cover has lateral marginal portions which are inclined with respect to the remainder of the profiled element, the inclined marginal portions abutting against the lateral wall portions of the frame of the housing. In this manner the floor-sweeping device of the present invention obtains a closed appearance at that side thereof which faces away from the surface being cleaned.

The novel features which are considered as characteristic for the invention are set forth in particular in the appended claims. The invention itself, however, both as to its construction and its method of operation, together with additional objects and advantages thereof, will be best understood from the followng description of a specific embodiment when read in connection with the accompanying drawing.

BRIEF DESCRIPTION OF THE DRAWING

FIG. 2 is a bottom plan view of the device of FIG. 1 with one of the corner-sweeping brushes removed;

FIG. 4 is a sectional view taken on line IV—IV of FIG. 2;

Figure 1:
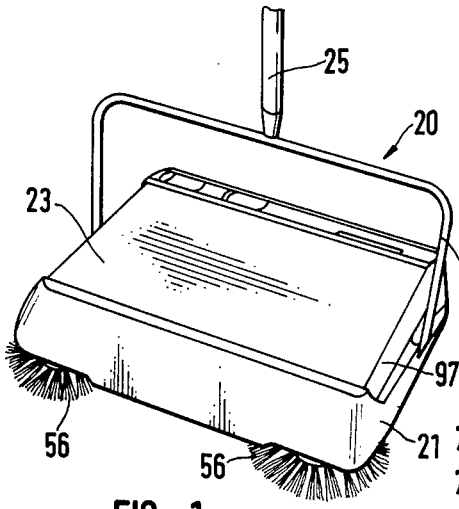
FIG. 1 is a perspective view of a floor sweeper equipped with a pair of rotating corner-sweeping brushes.
Figure 11:
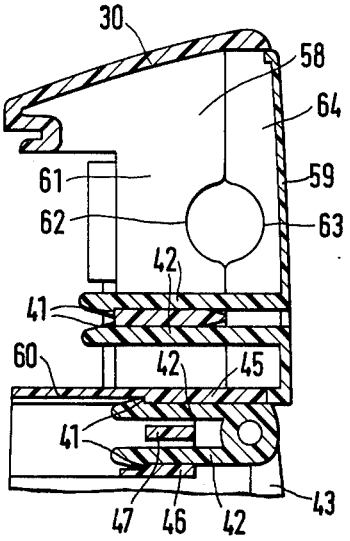
Figure 12:
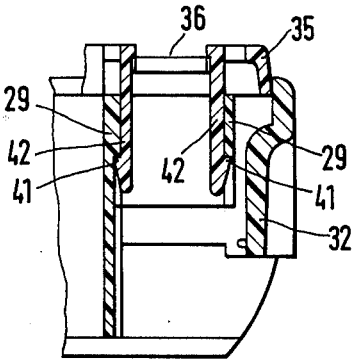
Figure 5:
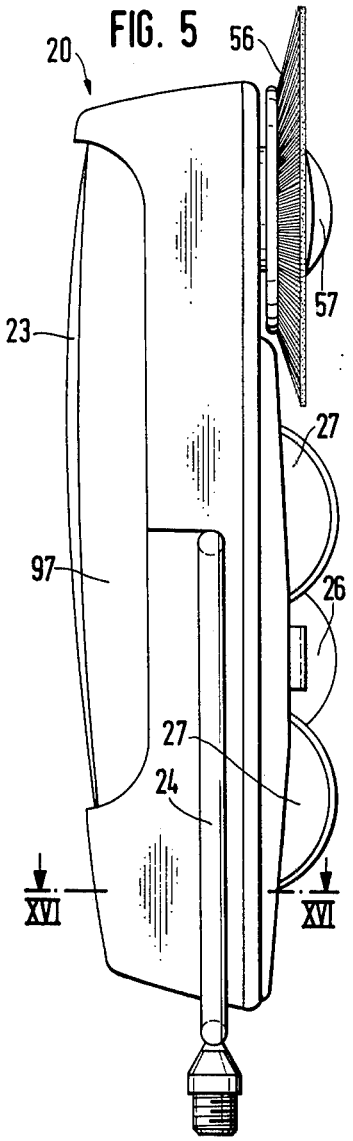
FIG. 5 is a side elevational view of the cleaning device of FIG. 1.
Figure 6:
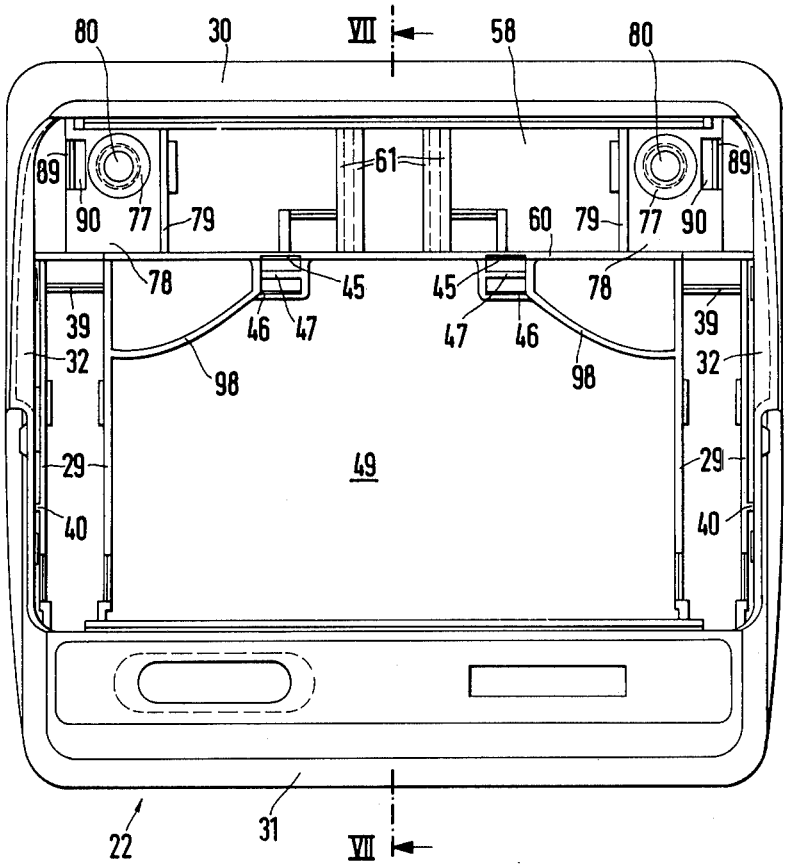
Figure 7:
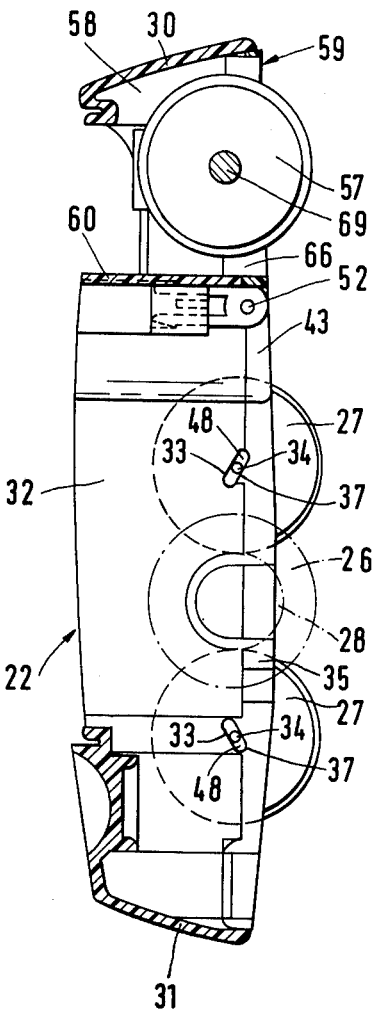
Figure 10:
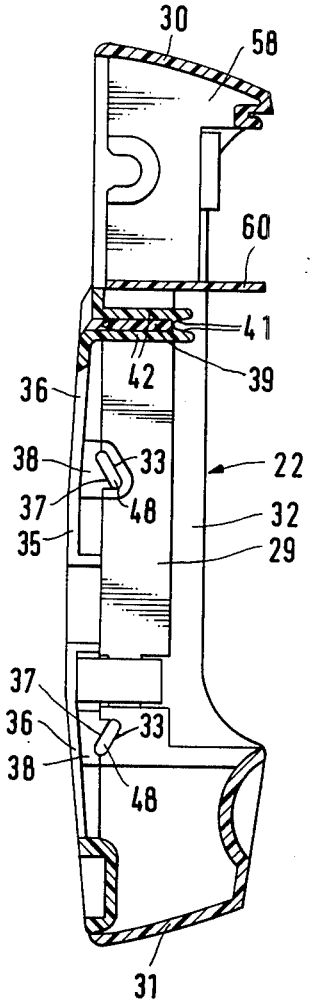
Figure 9:
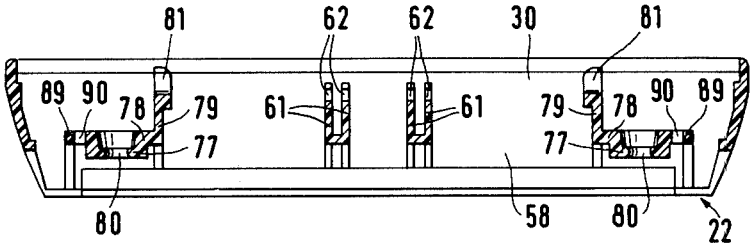
Figure 8:
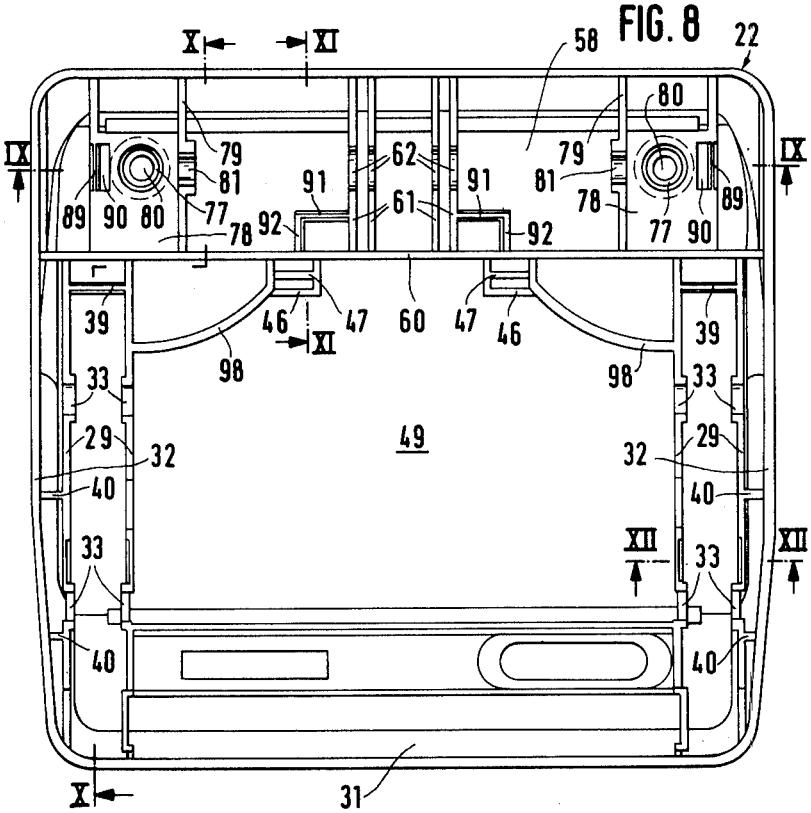

FIG.. 6 is a top plan view of a frame of the cleaning device of FIG. 1;

FIG. 7 is a cross-sectional view taken on line VII—VII of FIG. 6;

FIG. 8 is a bottom plan view of the frame of the cleaning device of FIG. 1;

FIG. 9 is a sectional view taken on line IX—IX of FIG. 8;

FIG. 10 is a sectional view taken on line X—X of FIG. 8;

FIG. 11 is a cross-sectional view taken on line XI—XI of FIG 8, partly fragmentized;

FIG. 12 is a partly fragmentized sectional view taken on line XII—XII of FIG. 8;

FIG. 13 is a top plan view of the bottom cover plate according to this invention;

FIG. 14 is a section taken along line XIV—XIV of FIG. 13;

FIG. 15 is a side elevational view partly broken away through the brush according to this invention; and FIG. 16 is a section taken along line XVI—XVI of FIG. 5.

DETAILED DISCUSSION OF A PREFERRED EMBODIMENT

Referring now to the drawings, and first to FIG. 1 thereof, it may be seen that the floor-sweeper 20 includes a housing 21 which includes a generally annular and circumferentially complete frame 22, and a cover 23 which is connected to the frame 22 and which closes that side of the frame 22 which faces away from the surface to be cleaned during the use of the device 20. The frame 22 is outwardly provided with recesses in which end portions of a bracket 24 are accommodated. An elongated handle 25 is connected to the bracket 24 and serves the purpose of moving the floor-sweeping device 20 over the surface to be swept. The frame 22 circumferentially surrounds a space in which there are accommodated and mounted various brushes and also wheels which serve to support the housing 21 for movement over the surface to be swept and also for driving the various brushes. A cylindrical brush 26 is mounted in the frame 22 which serves to pick up dirt from the surface to be cleaned by the floor-sweeper 20, and is rotatable about an axis which is transverse to the direction of movement of the housing 21 over the surface to be swept. The cylindrical brush 26 is rotated with respect to the surface from which dirt is to be picked up by means of driving wheels 27 which are in driving frictional contact with portions of the brush 26. For this purpose, the shaft of the brush 26 is provided with enlarged end portions 28, and two of the driving wheels 27 are arranged forwardly and rearwardly of the enlarged portions 28 at each lateral region of the housing 21, both of the respective two wheels 27 being in frictional contact with the enlarged end portion 28 of the shaft of the brush 26.

The wheels 27 are supported on and guided in bearings which are formed on support webs 29 which are arranged in pairs at lateral regions of the frame 22 and which receive the driving wheels 27 between them. The frame 22 includes a front wall 30, a rear wall 31 and two lateral or side walls 32. The support webs 29 increase the stability and ridigity of the frame 22. This means that the frame 22 and also webs 29 can be relatively thin so that the amount of material of which the housing 21 is made is significantly reduced. The frame 22 and the support walls 29 are so designed that the housing 21 can be easily manufactured of synthetic-resin material, such as by injection molding. The frame 22 has two open sides, one facing toward and the other away from the surface to be cleaned during the use of the device 20. This open configuration of the housing 21 means that a simple injection-molding mold or die can be used.

The webs 29 are provided with downwardly open bearing recesses 33. The driving wheels 27 have respective shafts 34 which are received in the bearing recesses 33. Covers 35 close the frame 22 in the lateral regions thereof with respect to the surface to be swept. The covers 35 include closing portions which close the open ends of the bearing recesses 33 and thus hold the shafts 34 of the driving wheels 27 therein. The covers 35 are provided with openings 36 for the driving wheels 27, and the closing portions include complementary upwardly open bearing recesses 37 which cooperate with the downwardly open bearing recesses 33 of the support walls 29 and are aligned therewith. The complementary bearing recesses 37 are provided on additional support walls 38 provided on the respective covers 35. Thus, when the device 20 is to be assembled, the shafts 34 of the driving wheels 27 are inserted into the bearing recesses 33 which are open toward that side of the housing 21 which faces toward the surface to be cleaned during the use of the device 20, and then the respective cover 35 is connected to the above-mentioned side of the housing 21. In this manner, the driving wheels 27 are reliably supported in the frame 22.

The webs 29 which extend substantially parallel to the respective lateral walls 32 of the frame 22 are connected by means of reinforcing webs 39 and 40 with lateral walls 32 of the frame 22 and/or with the webs 29 which are located at the other side of the driving wheels 27. In this manner, the ridigity of the frame 22 is further increased.

The covers 35 are provided with pairs of arms 42 which are equipped with barbs 41. The arms 42 with their barbs 41 serve to detachably connect the cover 35 to the webs 29 and reinforcing webs 39. As particularly seen in FIG. 10, one such pair of arms 42 is formed at the front end of the cover 35 and cooperates with the reinforcing web 39 which interconnects the webs 29 which, in turn, receive the driving wheels 27 between themselves. The arms 42 receive the reinforcing web 39 between themselves in a positive connecting manner. The arresting barbs 41 are provided at those sides of the arresting arms 42 which face one another and engage between the side of the reinforcing wall 39 which faces away from the surface to be swept. When the cover 35 is to be detached from the frame 22, the arresting arms 42 need merely be forced apart.

A further pair of arms 42 is provided in the region of the rear end of the cover 35. In this arrangement, the arms 42 are arranged at two sides of the opening 36 for the respective driving wheel 27, and they cooperate with the support webs 29 in the manner illustrated in FIG. 5. The arresting projections or barbs 41 are located at sides of the arms 42 which face away from each other and cooperate with edge portions of the support webs 29. When the cover 35 is to be detached from the frame 22, these two arresting arms 42 are pressed toward each other at their free ends.

The covers 35 which are arranged at the two lateral regions of the floor-sweeping device 20 are each provided at their front ends with a lateral extension 43 extending toward the center of the floor-sweeper 20. As best seen in FIG. 11, a further arresting arm pair 42 is arranged at the free ends of the extension 43, these arresting arms 42 cooperating with webs 45 and 46. The corresponding arresting projections 41 are arranged at those sides of the arresting arms 42 which face away from each other.

Furthermore, a dividing wall 47 is provided between the two arresting arms 42 in the holding position. When the cover 35 is to be detached from the frame 22, these arresting arms 42 are pressed toward each other at their free ends.

As most clearly seen in FIGS. 7 and 10, each bearing recess 33 provided on the support wall 29 forms with the corresponding bearing recess 37 formed on the cover 35 an elongated slot 48 which extends at an angle to the surface to be swept, that end of the elongated slot 48 which is closer to the cylindrical brush 26 being more spaced from the surface to be cleaned than the end of the elongated slot 48 which is remote from the cylindrical brush 26. Because of this inclination of the slot 48, the bearing wheels 27 are forcefully pressed against the enlarged end portion 28 of the shaft of the cylindrical brush 26 when the floor-sweeping device 20 is pressed against the surface to be cleaned so that the driving wheels 27 frictionally force the brush 26 to rotate about its longitudinal axis.

Dust-collecting receptacles 49 are provided in the frame 22 to both sides of the brush 26 and serve to collect dirt which is picked up from the surface being swept by the brush 26. The dirt-collecting receptacles 49 are formed by a cover plate or bottom wall 50 which is pivotable about an axle 51. The axle 51 is supported at its ends in holes 52 formed in mutually oppositely facing extensions 43 of the covers 35. Thus, when the cover 35 is assembled with the frame 22, the bottom wall 50 is simultaneously mounted in the housing 21. Tabs or projections 54 serve to open the bottom wall 50 but normally abut against the end portion of the frame 22 which faces the surface from which dirt is to be removed. The bottom wall 50 is provided with an opening 55 for the brush 26.

Since one dirt-collecting receptacle 49 is arranged in front of the cylindrical brush 26 and another dirt-collecting receptacle 49 is arranged in back of the brush 26, it is possible, during the operation of the device 20 which is moved over the surface to be cleaned in frontward end rearward directions of the housing, to deposit dirt in one or the other of the dirt-collecting receptacles depending on the direction of movement of the housing 21 over the surface to be cleaned since the change of direction of movement of the housing 21 over the surface to be cleaned simultaneously results in a change of direction of rotation of the wheels 27 about their axes and thus also in a change of direction of rotation of the brush 26 about its axis.

Inasmuch as the brush 26 can only pick up dirt from regions of the surface which are spaced a certain distance from the lateral walls 32 of the housing 21 of the floor-sweeper 20, corner-sweeping brushes 36 are provided which are operative primarily in the above-mentioned lateral regions of the housing 21. By means of these brushes 56 dirt can be lifted off the surface even in the lateral regions of the housing 21 which renders possible complete cleaning of the surface to be cleaned, that is, even in the regions of corners of such surface.

In the illustrated embodiment, one such corner-sweeping brush 56 is arranged at each of the front corners of the floot-sweeper 20 in such a manner that each of the brushes 56 is mounted on housing 21 for rotation about an axis which is substantially normal to the surface to be swept during the operation of the device 20, and each have an essentially cup-shaped annulus of bristles which extends radially outwardly and toward the surface to be cleaned. The ends of the bristles reach beyond the effective pick-up region of the cylindrical brush 26 on the one hand, and beyond the front wall and the respective side wall of the housing 21.

The corner-sweeping brushes are coupled with a driving wheel 57 so that they rotate in response to the rotation of the driving wheel 57. The driving wheel 57 and the two brushes 56 are arranged in a space 58 arranged at the front wall portion 30 of the frame 22 of the housing 21. A closure 59 is provided which closes the space 58 with respect to the surface to be cleaned. The space 58 is separated from the dirt-collecting receptacles 49 by a partition 60 which extends parallel to the front wall 30 of the frame 22. Thus, the dirt-collecting receptacle space 49 is bounded by the partition 60 and the inner one of the pair of support webs 29 which receive the driving wheels 27 between themselves, and the rear wall 31 of the frame 22. The corner regions between the partitioning wall 60 and the support walls 29 which are aligned with the extensions 43 are delimited by arcuate walls 98 and thus separated from the dirt-collecting receptacle 49. The corner regions which are in alignment with the extensions 43 are also in alignment with the bristles of the corner-sweeping brushes 56. In other words, the bottom wall 50 which closes the dirt-collecting space 49 toward the surface being swept does not reach into the effective operating region of the respective corner-sweeping brush 56.

Pairs of compartmenting walls 61 extend between the front wall 30 of the frame 22 and the partition 60. The walls 61 have open bearing recesses 62 for mounting portions 65 of the driving wheel 57.

The enclosed space 59 is formed with an opening 66 for the driving wheel 57, and is formed with pairs of additional compartmenting walls 64 at the two sides of the opening 66 which are aligned with the compartmenting 61 of the frame 22 and are formed with open bearing recesses 63 which cooperate with the bearing recesses 62 of the walls 61.

Figure 3:
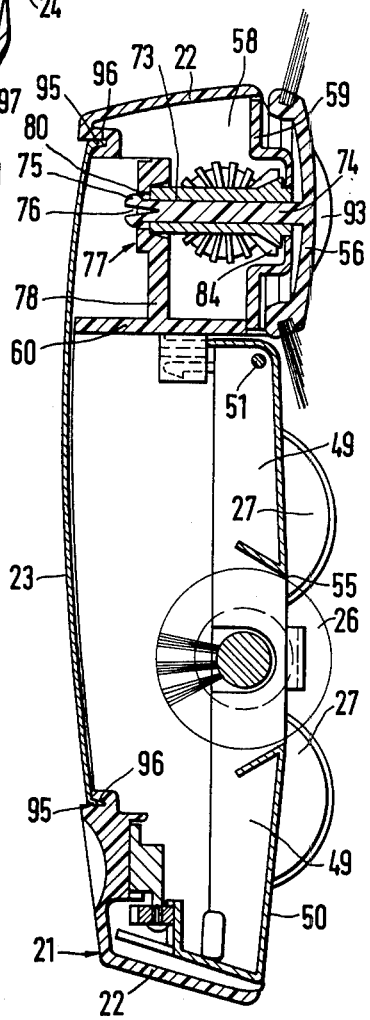
FIG. 3 is a sectional view taken on line III—III of FIG.2.

The driving wheel 57 is formed with an axial opening 67 of a non-circular cross section. Free ends 68 of shafts 69 which have corresponding noncircular cross sections are introduced into the opening 67 from both sides of the driving wheel 57 and are thus connected to the latter for joint rotation therewith. The shafts 69 connect the wheel 57 with the respective corner-sweeping brushes 56. The ends of the shafts 69 remote from the driving wheel 57 are provided with respective bevel gears 70. Each bevel gear 70 cooperates and meshes with an additional bevel gear 71 which is formed on a driving wheel 72. As particularly seen in FIGS. 3 and 4, the driving sleeve 72 is rotatably mounted in a part of the frame 22 which will be discussed in more detail below.

The driving sleeve 72 extends substantially normal to the surface from which dirt is to be removed and has a longitudinally extending receiving space 73 (FIG. 3) which accommodates a corresponding pin 74 of the corner-sweeping brush 56. The pin 74 of the corner-sweeping brush 56 is mounted in the driving sleeve 72 for limited displacement axially of the latter, but is connected to the driving sleeve 72 for joint rotation therewith. The pin 74 of the corner-sweeping brush 56 is mounted on the driving sleeve 72 in such a manner that a head 75 provided at the free end of the pin 74 has a larger diameter than the inner diameter of the driving sleeve 72, while an axial slot 76 is provided in the head 75 to allow compression of the head of the pin 74. In this manner, when the pin 74 of the corner-sweeping brush 56 is introduced into the driving sleeve 72, the head 75 of the pin 74 is resiliently compressed so that the head 75 assumes its original size after the passage of the free end portion of the pin 74 through the driving sleeve 72, so that the pin 74 is connected to the driving sleeve 72 in the proper operative position. The part of the pin which is located between the head 75 and the body of the corner-sweeping brush 56 is somewhat longer than the driving sleeve 72. In this manner, the corner-sweeping brush 56 can move limitedly axially relative to the driving sleeve 72 to compensate for unevenness of the surface which is being swept.

The driving sleeve 72 has a cylindrical end portion which is remote from the body of the corner-sweeping brush 56 and which is received in an essentially cup-shaped depression 77 formed in a mounting wall 78. The mounting wall 78 extends essentially parallel to the surface to be swept, is accessible from above and from below, and is formed on the partition 60. A further partition 79 is located between the partition 60 and the front wall 30. Thus, the mounting wall 78 is formed in a very simple manner of one piece with the frame 22 and further increases the rigidity of the frame 22. The cup-shaped depression 77 has a surface which conically diverges toward the body of the corner-sweeping brush, the outer diameter of the driving sleeve 72 essentially corresponding to the smallest inner diameter of the conical depression 77. An opening is provided in the bottom of the cup-shaped depression 77 which accommodates the free end of the pin 74 which extends beyond the driving sleeve 72. The conical configuration of the depression 77 renders possible a limited tilting of the driving sleeve 72 and thus of the corner sweeping brush 56, as will be described later.

The additional mounting wall 79 which is of one piece with the mounting wall 78 and is located between the front wall 30 of the frame 22 and the partition 60 is provided with a bearing recess 81 for the shaft 69 of the auxiliary driving wheel 57. The closure 59 which closes the frame 22 in this region in a direction toward the surface being swept is provided with an additional mounting wall 82 which is formed with a bearing recess 83 which opens away from the surface to be swept. The additional mounting wall 82 is located adjacent the partition 79 so that each shaft 69 which connects the auxiliary driving wheel 57 with the corner-sweeping brush 56 is reliably supported in the bearing recesses 81 and 83.

The driving sleeve 72 is further mounted in the region of the body of the corner-sweeping brush 56 at the closure 59. The bearing for this and of the driving sleeve 72 is constituted by a slot 84 elongated in the direction of movement of the floor-sweeping device 20 over the surface being swept. The slot 84 is so dimensioned that the driving sleeve 72 can move from a central position by 1 millimeter forwardly and rearwardly. The end of the driving sleeve 72 which cooperates with the elongated slot 84 includes a cylindrical portion 85 which forms an annular shoulder 86. The annular shoulder 86 abuts against the closure 59 around the elongated slot 84. In this manner the driving sleeve 72 is reliably held between the wall portion 78 and the closure 59. The assembly of the corner-sweeping brush 56 with the housing 20 is very simple in that merely the driving sleeve 72 need be introduced into the cup-shaped depression 77 of the mounting wall 78, and then subsequently the closure 59 is connected to the frame 22 of the housing 21.

The closure 59 which is provided with the elongated slot 84 is formed in the region of the bearings with an outwardly bulging portion which is received in an annular depression 87 provided in that side of the corner-sweeping brush 56 which faces the closure 59. In this manner, the overall height of the floor-sweeping device 20 from the surface to be cleaned is substantially reduced.

As already mentioned, the shafts 69 are provided, at their end portions remote from the auxiliary driving wheel 57 with bevel gears 70 which cooperate and mesh with the bevel gears 71 of the driving sleeves 72. The bevel gear 70 which is mounted on the shaft 69 for joint rotation therewith abuts against the additional mounting wall 79 with a bearing surface 88 provided at the rear end thereof. In this manner, the bevel gear 70, and thus the additional shaft 69, are reliably mounted in the housing 21 and held against axial displacement.

The closure 59 is connected to the frame 22 with pairs of snap-action arresting arms 42 which are equipped with barbs 41 as described above. One pair of arresting arms 42 is arranged at each end of the closure 59 and cooperates with a portion 89 which is formed on the mounting wall portion 78 by an opening 90. The arresting projections 41 are provided on those sides of the arresting arms 42 which face away from each other. A similar pair of arresting arms 42 is arranged to the right and to the left of the opening 66 for the auxiliary driving wheel 57. These pairs of arms 42 cooperate with portions 91 which are formed on the compartmenting walls 61 and are connected to the partition 60 by means of brackets 92. Even in these arresting arm pairs 42, the arresting projections 41 are arranged at the oppositely facing side of the arresting arms 32. When the closure 59 is to be detached from the frame 22, the free ends of the respective arresting arms 42 are pressed toward each other. For connecting the closure 59 to the frame 22, the arresting projections 41 are provided with chamfered front edge portions, and the brackets and other portions which cooperate with the arresting projections 41 also have inclined surfaces so that an arresting cooperation of the various components is obtained following a simple pressing of the closure 59 against the frame 22. The body of each corner-sweeping brush 56 has a ball-shaped surface 93 which abuts against the surface from which dirt is to be removed. Thus, when the floor-sweeper 20 is moved over the surface to be cleaned, the body of the corner-sweeping brush 56 is retained by the friction between itself and the surface to be cleaned so that the brush 56 is slightly displaced within the confines of the elongated slot 84 in the rearward direction when considered in the instantaneous direction of movement of the housing 21 of the surface to be swept. As a result of this, the portion of the annulus of bristles of the corner-sweeping brush 56 which is located at the front when considered in the direction of movement of the housing 21 over the surface is in brushing contact with the surface, while the portion of the annulus of bristles which is in the rear when considered in the direction of movement of the housing 21 over the surface to be swept is slightly lifted from such surface. The driving movement of the driving wheel 57 is so transmitted to and converted into rotation of the corner-sweeping brush 56 that the portion of the annulus of bristles of the corner-sweeping brush 56 which is in sweeping or brushing contact with the surface to be swept moves toward the center of the device 20 so that the dirt is moved forward from the lateral regions of the housing 21 to the path of effective movement of the cylindrical brush 26. Thus, the brush 26 is capable of picking up also such additional dirt coming from the lateral regions of the housing and depositing the same into the dirt-collecting receptacles 49. In view of the fact that the floor-sweeper 20 moves forwardly and backwardly during cleaning, and in view of the fact that such movement of the housing 21 results in corresponding rotation of the driving wheels 27 and 57 as well as concomitant reversal of the direction of rotation of the brushes 27 and 56, and further in view of the fact that the portion of the annulus of bristles of the additional corner-sweeping brushes 56 in contact with the surface to be cleaned rotates always in direction toward the center of the device 20, the dirt which is located in regions which are outside of the path of cleaning of the cylindrical brush 26 is constantly moved toward the cylindrical brush 26 by the additional corner-sweeping brushes 56 in each movement phase of the device 20. Thus, corner-sweeping brushes 56 can conduct sweeping operations regardless of the direction of movement of the housing 21 over the surface to be cleaned. As a result of the mirror-image arrangement of the corner-sweeping brushes 56 in both front corner regions of the floor-cleaning device 20, such regions of the surface to be cleaned can be reached during the movement of the housing 21 over such surface which are located to both sides of the path of movement of the cylindrical main brush 26, such as regions along baseboards or furniture bases.

As already mentioned above, the frame 22 is upwardly open and can be closed by means of a protective cover 23 which is constituted by a profiled sheet-metal element. The cover 23 includes front and rear marginal portions inclined with respect to the remainder of the profiled element 23, and the frame 22 includes clamping slots 76 in which the inclined marginal portions 95 of the profiled protective cover 23 are received and clamped. The protective cover 23 is further provided with inclined marginal portions 97 at the lateral portions thereof, such marginal portions 97 abutting against the lateral walls 32 of the frame 22.

As shown in particular in FIGS. 13 and 14 the brush 26 is pivoted on the bottom wall or cover plate 50. To this end the brush is formed at its end with cylindrical recesses 101 shown in FIG. 15 in which can fit a pin riveted at 104 to tabs 102 extending from lateral projections 103 of the plate 50. This plate 50 is generally planar and is formed unitarily of chrome-plated sheet steel. Thus when the cover plate 50 is opened the brush 26 is also pivoted out of the way so that the receptacles 49 are readily accessible.

In addition as also shown in FIG. 16 the position of the cover plate 50 on the housing 21, which also of course determines the position of the brush 26 relative to the housing 21, can be regulated. To this end the plate 50 has a bent-up front wall 106 from which is punched out and bent over a tab 107 along a bend line 108 extending at an angle to the plane of plate 50. This bent-up tab or tongue 107 coacts with an abutment 105 carried on the housing and constituted as a magnet 110 carried on a slider 111. A handle 112 accessible from outside of the housing allows the slider 111 and, therefore, the magnet 110 to be displaced along the inclined surface 107 so as to vary the rest position of the plate 50. In addition a window 113 in the housing exposes indicia on the slide 111 so that the height setting of the roller 26 can be read through this window 113.

As the magnet 110 is moved to the right as shown in FIG. 16 the plate 50 is pressed down and the brush 26 can be used to clean bare floors. When the magnet 110 is moved to the left as shown in FIG. 16 the brush 26 is pulled back up into the housing 21 and can be used for carpets even having a relatively deep pile.

It will be understood that each of the elements described above, or two or more together, may also find a useful application in other types of constructions differing from the types described above.

While the invention has been illustrated and described as embodied in a floor-sweeper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A carpet or floor sweeper comprising: a housing displaceable forwardly and oppositely backwardly in a normal direction of travel and having an open bottom; a plurality of floor-engaging wheels rotatable on said housing; a cover plate closing said bottom of said housing and formed with a central hole and forming to at least one side of said hole a dust-catching receptacle; means pivoting said plate on said housing about an axis extending transverse to said direction; a rotatable brush elongated transverse to said direction extending through said hole; means mounting the elongated brush on said cover plate for rotation of said elongated brush about its longitudinal axis; and means operatively connecting said brush to said wheels for rotation of said brush by said wheels.

2. The sweeper defined in claim 1 wherein said brush has two end portions and said plate has a tab portion adjacent each of said end portions and forming with the respective end portion a respective portion pair, one of each of said portions of each pair having a cylindrical hole centered on the brush rotation axis and the other portion of each pair having a pin received in said cylindrical hole, said pins and said cylindrical holes constituting said means mounting.

3. The sweeper defined in claim 2 wherein said pins are provided on said tab portions.

4. The sweeper defined in claim 3 wherein said plate is unitarily formed of sheet metal with said tab portions.

5. The sweeper defined in claim 4 wherein said pins are riveted in said tab portions.

6. The sweeper defined in claim 1, further comprising means for pivotally varying the position of said cover plate and said brush on said housing.

7. The sweeper defined in claim 6 wherein said means for varying includes a displaceable abutment on said housing engageable with said plate remote from the pivot axis thereof.

8. The sweeper defined in claim 7 wherein said plate has a surface inclined relative to said pivot axis and engageable with said abutment.

9. The sweeper defined in claim 8 wherein said plate has a bent-up tongue constituting said surface.

10. The sweeper defined in claim 9 wherein said plate is generally planar and said bent-up tongue has an edge inclined to the plane of said plate.

11. The sweeper defined in claim 6, further comprising a magnet engageable with said plate at a location remote from the pivot axis thereof for holding said plate on said housing.

12. The sweeper defined in claim 11 wherein said magnet constitutes said abutment and said means for varying includes a handle actuatable from outside said housing for displacing said magnet on said housing.

13. The sweeper defined in claim 12, further comprising a window on said housing and indicia carried by said abutment visible from outside said housing through said window.

* * * * *